US005079908A

United States Patent [19]

Stahlecker

[11] Patent Number: 5,079,908

[45] Date of Patent: Jan. 14, 1992

[54] ARRANGEMENT FOR CARRYING OUT A YARN PIECING OPERATION AT A SPINNING POINT OF A SPINNING MACHINE

[75] Inventor: Fritz Stahlecker, Bad Überkingen, Fed. Rep. of Germany

[73] Assignee: Hans Stahlecker, Fed. Rep. of Germany; a part interest

[21] Appl. No.: 483,716

[22] Filed: Feb. 23, 1990

Related U.S. Application Data

[63] Continuation-in-part of Ser. No. 398,429, Aug. 25, 1989, Pat. No. 4,972,668.

[30] Foreign Application Priority Data

Aug. 27, 1988 [DE] Fed. Rep. of Germany ..... 3829151
Feb. 25, 1989 [DE] Fed. Rep. of Germany ..... 3905940

[51] Int. Cl.[5] ..... D01H 15/00; D01H 13/26

[52] U.S. Cl. ..... 57/261; 57/22; 57/264; 57/352

[58] Field of Search ..... 28/141, 272; 57/22, 57/261, 264, 333, 352

[56] References Cited

U.S. PATENT DOCUMENTS

| | | | |
|---|---|---|---|
| 3,763,669 | 10/1973 | Bous et al. | 57/264 X |
| 4,121,409 | 10/1978 | Uchida et al. | 57/261 X |
| 4,356,692 | 11/1982 | Karl et al. | 57/263 |
| 4,419,861 | 12/1983 | Fujiwara et al. | 57/261 |
| 4,598,539 | 7/1986 | Stahlecker et al. | 57/305 X |
| 4,944,145 | 7/1990 | Stahlecker | 57/261 |
| 4,958,486 | 9/1990 | Stahlecker | 57/328 |
| 4,972,668 | 11/1990 | Stahlecker | 57/261 |
| 4,995,229 | 2/1991 | Stahlecker | 57/261 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

An arrangement is disclosed for carrying out a yarn piecing at a spinning point of a spinning machine. The arrangement includes devices for connecting the old and the new yarn, devices for the intermediate storage of the yarn length of the new yarn produced during the connecting, and devices for winding the connected yarn onto a spool package. It is provided that a control device for the drive of the package spool is connected to a device for determining the expected point in time of the using-up of the intermediately stored yarn length and controls the reduction of the speed of the devices for the winding-up.

25 Claims, 5 Drawing Sheets

ARRANGEMENT FOR CARRYING OUT A YARN PIECING OPERATION AT A SPINNING POINT OF A SPINNING MACHINE

BACKGROUND AND SUMMARY OF THE INVENTION

This application is a Continuation-in-Part application of Application Ser. No. 07/398,429, filed Aug. 25, 1989, now U.S. Pat. No. 4,972,668.

The invention relates to an arrangement for carrying out a yarn piecing operation at a spinning unit or point of a spinning machine. The yarn piecing apparatus includes devices for taking over an end piece of an old yarn wound onto a package, devices for taking over a new yarn produced by the spinning point, devices for connecting the old and the new yarn, devices for the intermediate storage of the yarn length of the new yarn produced during the connecting, and devices for winding the connected yarn onto a spool package which contain a package drive. The package drive is controlled by a controlling device which is held at a speed which is increased in comparison to the operating speed until the intermediately stored yarn length is used up,.

An arrangement of this type is the object of the above identified U.S. application (Corresponding also to German Patent Application P 38 29 151.7). It is endeavored, after establishing the yarn connection, to evacuate the intermediate storage device as fast as possible so that the concerned spinning point may resume its operative condition as soon as possible. This is particularly useful in the case of a movable arrangement which is assigned to a plurality of spinning points so that the arrangement will be ready again as soon as possible for a piecing operation at another spinning point. In addition, it must be ensured that, when the intermediate storage device is evacuated, the yarn is not stressed excessively. Particularly in the case of a yarn with a low resistance to tearing, this stress may otherwise result in a yarn breakage. A particularly critical point in time is at the end of the using-up of the intermediately stored yarn length, because at the latest at that point the withdrawing can no longer take place at a high wind-up speed because otherwise a tension peak may occur which results in the destruction of the yarn.

An object of the present invention is to develop an arrangement of the initially mentioned type such that, on the one hand, a fast evacuation of the intermediate storage device is possible and, on the other hand, tension peaks are largely avoided.

This object is achieved according to preferred embodiments of the invention in that the control device is connected to a device for determining the expected point in time of the using-up of the intermediately stored yarn length and, as a function of that, controls the reduction of the speed of the devices for the winding-up.

By means of this development, the circumstance is taken into account that the wind-up operation, during the evacuation of the intermediate storage device, may take p lace at very different conditions and at very different speeds. The packages may have very different diameters and/or also differences in the density of the winding and thus in the hardness of the surface so that very different acceleration behaviors occur, by which the packages are accelerated up to the increased wind-up speed. Here it must also be observed that the yarn must by no means be wound onto the package too loosely because this ma result in difficulties during the further processing. These different conditions which lead to a different slippage between a driving element and a package, are taken into account by monitoring the winding-up and determining the point in time at which the using-up of the intermediately stored yarn length is expected. Correspondingly, the speed of the package is controlled so that tension peaks are avoided. It is therefore possible to precisely control the speeds at the start as well as at the end of the wind-up up at increased speed, so that smooth transitions are obtained.

In a further development of the invention, it is provided that that the control device contains a computer determining the time period that remains for the using-up, a signal generating device being assigned to this computer which generates a signal that is representative of the yarn length still to be wound up. The drive will then be controlled as a function of the actual circumstances so that all sources of error are compensated which occur as a result of different slippage conditions between the driving element and the package.

In a first embodiment of the invention, it is provided that the signal generating device contains devices for detecting the length of a yarn loop received in the intermediate storage device. By means of a continuous monitoring of the intermediately stored yarn length, the evacuation of the intermediate storage device can therefore be controlled very precisely.

In another embodiment of the invention, it is provided that the signal generating device contains devices connected to the intermediate storage device for detecting the point in time at which the stored yarn loop during the evacuation has a given residual size. The point in time of the reaching of this residual size of a yarn loop is a sufficiently accurate signal from which the expected end of the using-up of the intermediately stored yarn length may be determined.

In a further embodiment of the invention, it is provided that an additional storage device, which receives a defined yarn length, is connected in front of the intermediate storage device, and in that the signal generating device contains devices for detecting the yarn at the point in time of leaving the intermediate storage device. In these embodiments, it is also not important which length of the yarn was in fact stored in the intermediate storage device.

In a further embodiment of the invention, it is provided that the signal generating device contains devices for detecting the course of the wind-up speed after the connecting of the old and the new yarn. This embodiment is based on the fact that it is certain with sufficient accuracy which length of yarn is stored in the intermediate storage device so that, on the basis of the course of the wind-up speed, the point in time of the using-up of the yarn length can be determined. In another embodiment, it is provided under the same conditions that the signal generating device contains devices for detecting the yarn length withdrawn from the intermediate storage device after the connecting. It is also a prerequisite here that the yarn length to be withdrawn is known with sufficient accuracy. Since this yarn length is a function of the delivery speed of the spinning point at which the yarn piecing is carried out, this is known with sufficient accuracy.

Other objects, advantages and novel features of the present invention will become apparent from the following detailed description of the invention when considered in conjunction with the accompanying drawings.

DETAILED DESCRIPTION OF THE DRAWING

Figure 1:
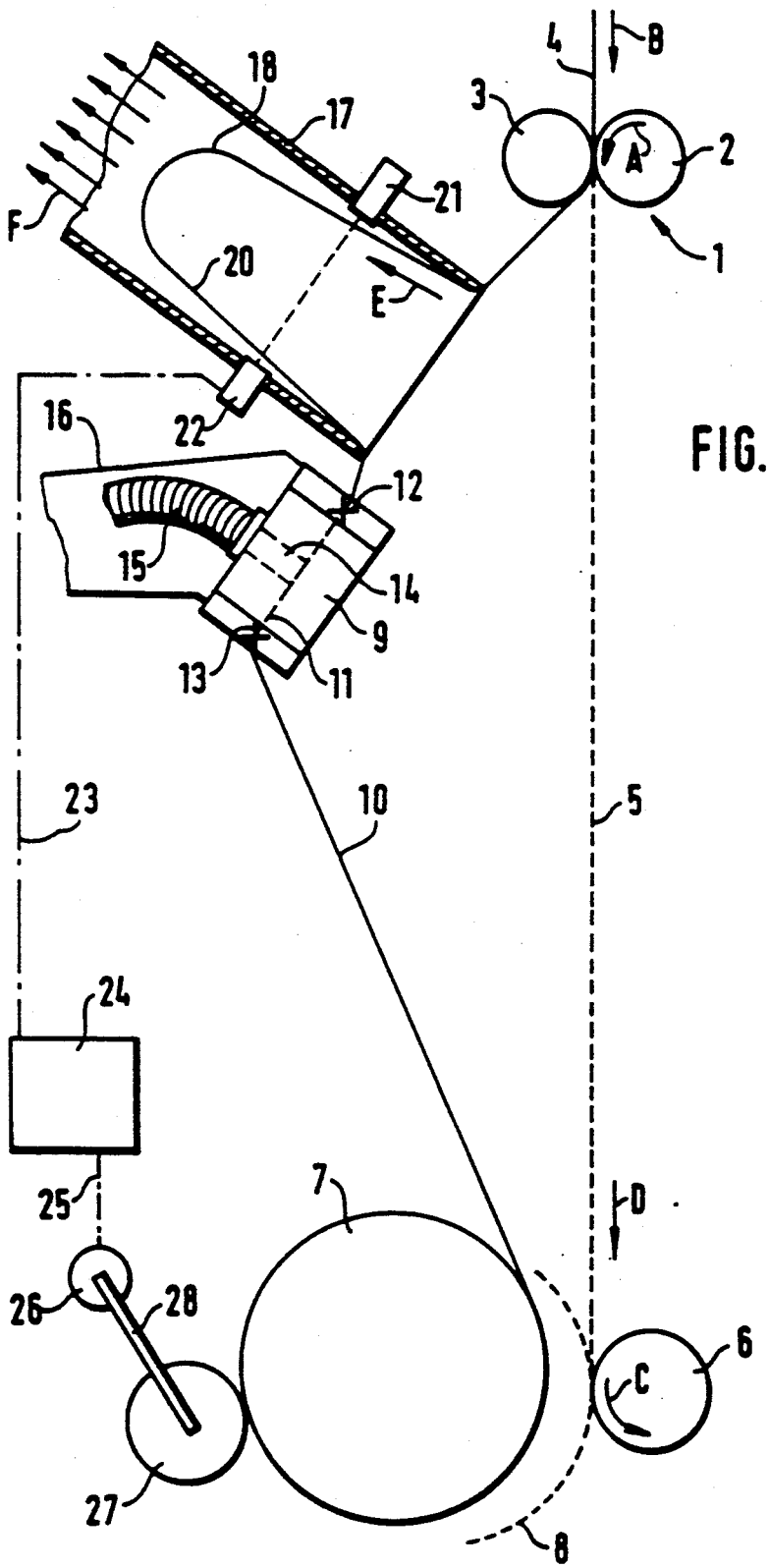
FIG. 1 is a schematic representation of an arrangement according to the invention during the connecting of an old and a new yarn and during the filling of an intermediate storage device.

In the drawings, only a delivery device 1 is shown of an individual spinning point of a spinning machine. This delivery device 1 is formed by two delivery rollers 2 and 3. These delivery rollers 2 and 3, which rotate in the direction of arrow (A), deliver a yarn 4 in the direction of arrow (B). As outlined by means of a dotted line in FIG. 1, the delivered yarn 5 moves in the direction of arrow (D), to a wind-up device which contains a winding roller 6 rotating in the direction of arrow (C). The winding roller 6 drives a spool package 7 which, in a manner not shown in detail, is held by means of a spool frame and which, during the operation, is located in the position 8 shown by the interrupted line. If a yarn 5 is to be wound up which has only a relatively low resistance to tearing, such as a double yarn 5 formed by two yarn components which are only prestrengthened by pneumatic false-twist spinning, the wind-up speed is only slightly higher than the delivery speed. The speed difference only has the purpose of ensuring that a sufficient yarn tension is obtained for achieving a correct package structure.

After a yarn breakage, a piecing must be carried out at the spinning point. In principle, this is carried out such that the old yarn 10 is withdrawn from the package 7, which is then lifted off the winding roller 6, and this old yarn 10 is connected with a new yarn 20 which is delivered again by the switching-on of the spinning point. This connecting takes place, for example, by means of a pneumatic splicing arrangement 9 into which the old yarn 10 and the new yarn 20 are placed. The splicing arrangement 9 which is arranged on an arm 16 of a moving servicing arrangement which preferably can be selectively applied to the spinning point, contains a splicing duct 11 into which the yarns 10, 20 are placed. By means of a compressed-air nozzle 14, this splicing duct 11 is connected with a compressed-air supply line 15 which is connected in a known manner, by way of a valve to a compressed-air source.

The splicing arrangement 9, in a conventional manner, contains yarn clamps 12, 13 which are only outlined. During the establishment of the spliced connection, the two yarns 10, 20 are held in a clamped manner. The length of the yarn 20 which, continues to be delivered during this time by the delivery device is received in an intermediate storage device 17.

As mentioned above, the servicing arrangement which carries out the yarn piecing, can be moved along a spinning machine and can be applied to the individual spinning points is shown only schematically and not completely. This servicing arrangement contains suction grippers which are not shown and which pick up the old yarn 10 at the package 7 and place it in the splicing arrangement 9. In this case, the package 7 is driven by means of an auxiliary winding roller 27 which can be swivelled around an arm 28 and which has a drive 26 that is shown only schematically and by means of which the auxiliary winding roller 27 can be driven in both rotating directions. Likewise, the servicing arrangement has a suction gripper which picks up the newly spun yarn at the delivery device 1 and places it in the splicing arrangement 9.

Figure 2:
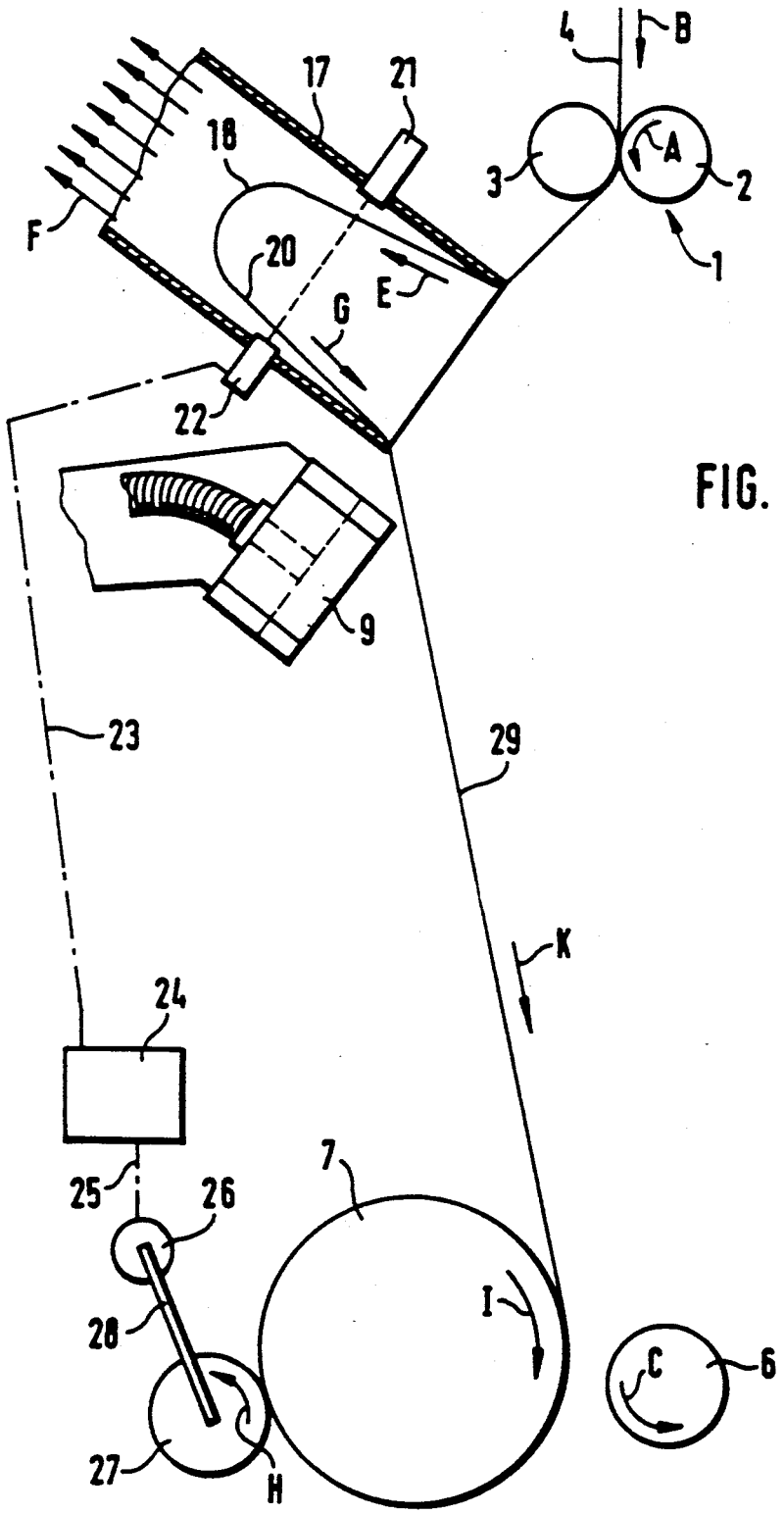
FIG. 2 is a view of the embodiment according to FIG. 1 at a later point in time, specifically after the establishing of the yarn connection and during the winding-up of the intermediately stored yarn length.

As soon as the spliced connection is established between the old yarn 10 and the new yarn 20, the splicing arrangement 9 is opened up so that the pieced yarn 29 is released (FIG. 2). The auxiliary winding roller 27 is switched on in wind-up direction (direction of arrow H) so that the package spool 7 is driven in wind-up direction (direction of arrow I). The pieced yarn 29 is withdrawn in the direction of arrow (K) and is wound onto the package spool 7.

The pieced yarn 29 is withdrawn from the intermediate storage device 17 in the direction of arrow (G), while, on the other side, at the same time, in the direction of arrow (E), another yarn enters into the intermediate storage device 17. The intermediate storage device 17 consists, for example, of a tube which is open on one side and with the open side can be applied to the path of the yarn and which is connected to a suction air source so that a suction pull is generated in direction (F) which holds the newly produced yarn in the form of a yarn loop 18 taut in the intermediate storage device 17. In order to evacuate the intermediate storage device 17, the winding speed (movement in the direction of arrow (G)) must be higher than the delivery speed (direction of arrow (E)). In order to evacuate the intermediate storage device 17 as fast as possible, the spool package 7 is driven for this purpose at a winding speed that is as high as possible. When the intermediately stored yarn length is used up and the yarn essentially resumes the operative course (interrupted line 5 in FIG. 1), the winding speed must again be adapted to the delivery speed of the delivery device 1 so that no tension peak is created which may lead to a tearing of the yarn, and so that the package spool can again be transferred to the winding roller 6 (position 8 in FIG. 1). In order to permit a smooth transition, in time, from the high wind-up speed to the lower operative winding speed, the drive 26 of the auxiliary winding roller 27 is connected by way of a connection 25, to a control device 24 containing a computer which controls the speed of the auxiliary winding roller 27. The control device 24 is connected by means of a connecting line 23 to a detector 21, 22, such as a light barrier which is connected to the intermediate storage device 17. This detector 21, 22 detects the point in time at which the yarn loop 18 has reached a residual size and leaves the range of the detector 21, 22. From this, the computer of the control device 24 computes the still remaining time period to that point in time at which the excessive yarn length is used up completely and the yarn will reach the operative position (interrupted line 5 of FIG. 1). Correspondingly, the control device 24 controls the drive 26 such that the high wind-up speed, in the remaining time period, is reduced to the lower operative wind-up speed. Subsequently, the package spool 7 is then transferred again to the winding roller 6 of the spinning point (position 8 in FIG. 1); see also FIG. 3. In this case, it may be provided that the auxiliary winding roller 27 follows the package spool 7 so that the package spool 7 (in position 8), for a short time, is driven by the auxiliary winding roller 27 as well as by the winding roller 6 until it is certain that a sufficient driving pull is reached between the winding roller 6 and the package spool 7.

Figure 3:
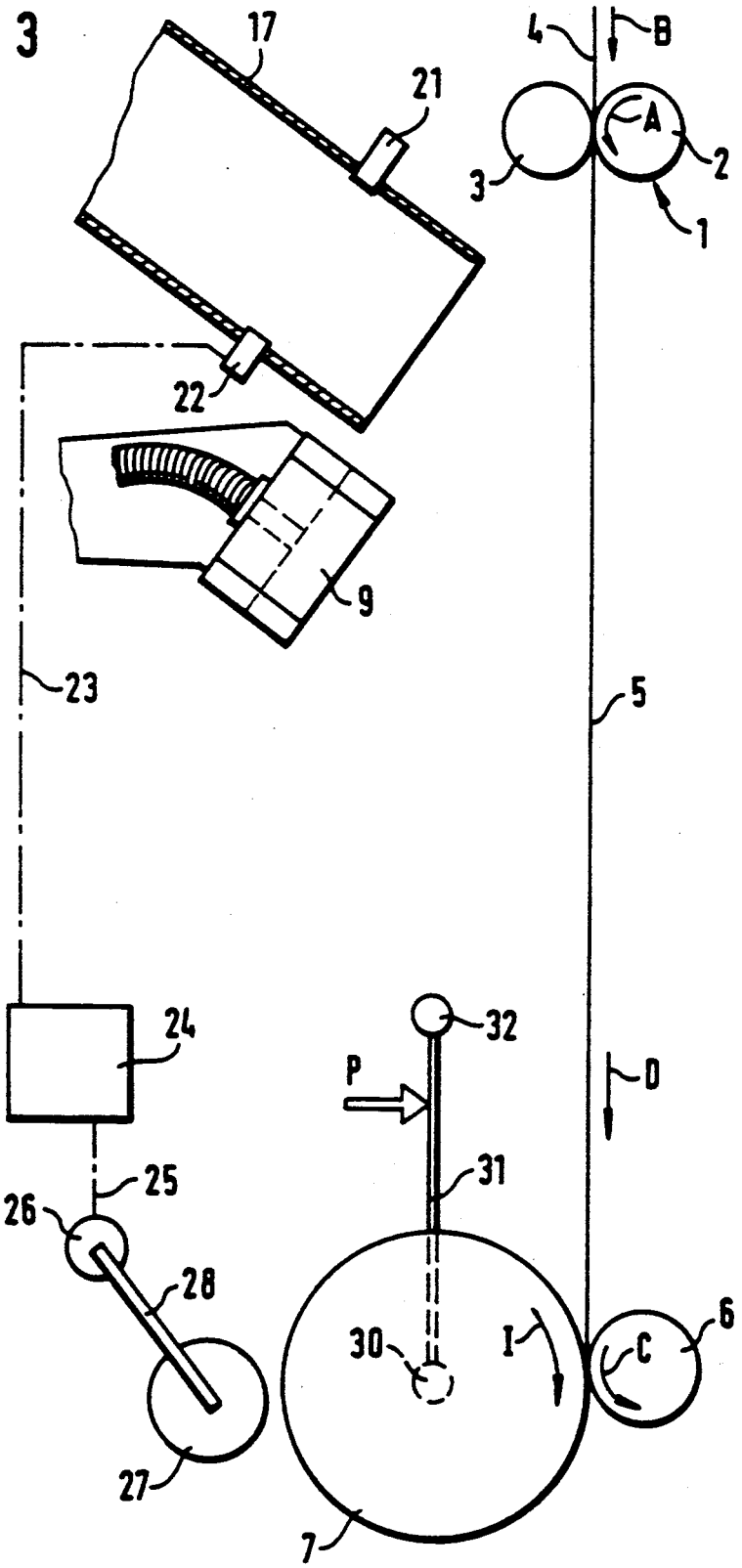
FIG. 3 is a view of the embodiment according to FIG. 1 and 2 after the termination of the yarn piecing and evacuating of the intermediate storage device.

In the case of a modified embodiment, which is shown in FIG. 3, the spool package 7 leaves the auxiliary winding roller 27 during the transfer. The spool package 7 has a spool frame 31 which holds the spool tube 30 of the spool package 7. This spool frame 31 can be swivelled around a shaft 32 fixed at the machine. During the transfer into the operative position, the servicing device exercises an additional load (P) on the spool frame 31 so that the package spool 7 is pressed against the winding roller 6 with an increased force. As a result, a possible slippage between the winding roller 6 and the package spool 7 is reduced.

In the embodiments according to FIGS. 4 and 5, explained below, the same reference numbers are used for the spinning point and the servicing arrangement to the extent that they are corresponding elements to the embodiments of FIG. 1-3. These elements will not be explained again.

Figure 4:
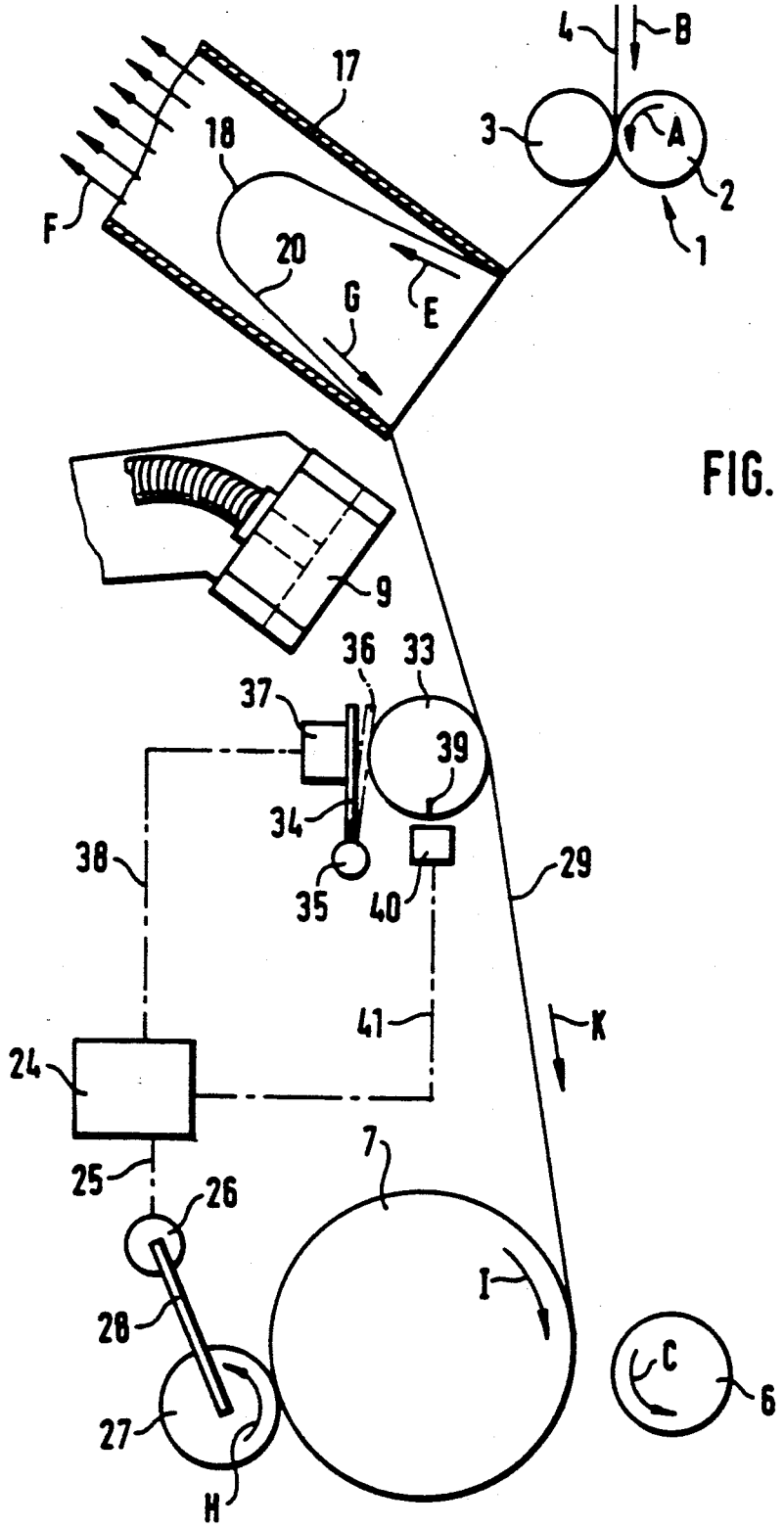
FIG. 4 is a view similar to FIGS. 1 to 3, showing a modified embodiment after the establishment of a yarn connection and during the withdrawal of the yarn from an intermediate storage device having a signal generating device which determines the withdrawn yarn length or the course of the withdrawal.

In the embodiment according to FIG. 4, a measuring wheel 33 of the servicing arrangement is brought into the moving path of the connected yarn 29. This measuring wheel 33 is disposed to run as smoothly as possible and is constructed with as little inertia as possible. A brake is assigned to the measuring wheel 33 and consists of a brake lever which can be swivelled around a shaft 35 between positions 34 and 36 and which normally rests against the measuring wheel 33 and is lifted off by a magnet 37 which is connected with the control device 24 by means of a line 38. This brake is released with the start of the wind-up operation started by the auxiliary winding roller 27 so that the measuring wheel 33 is taken along. The measuring wheel 33 is provided with one or several markings 39 opposite which a signal receiver 40 is arranged which, by way of a line 41, is connected to the control device 24 containing a computer. The measuring wheel 33 measures the withdrawn yarn length and emits corresponding signals to the computer of the control device 24. From these signals the computer determines the expected point in time at which the intermediately stored yarn length is withdrawn and the moving path of the pieced yarn will correspond essentially to the operative yarn moving path. Correspondingly, prior to that, the increased wind-up speed is reduced with a smooth transition, to the operative wind-up speed, after which the package spool 7 is transferred to the winding roller 6 of the spinning machine.

In a modified embodiment, the measuring wheel 33 is applied to the package spool 7 so that it measures the actual winding speed at the circumference of the package spool 7.

Figure 5:
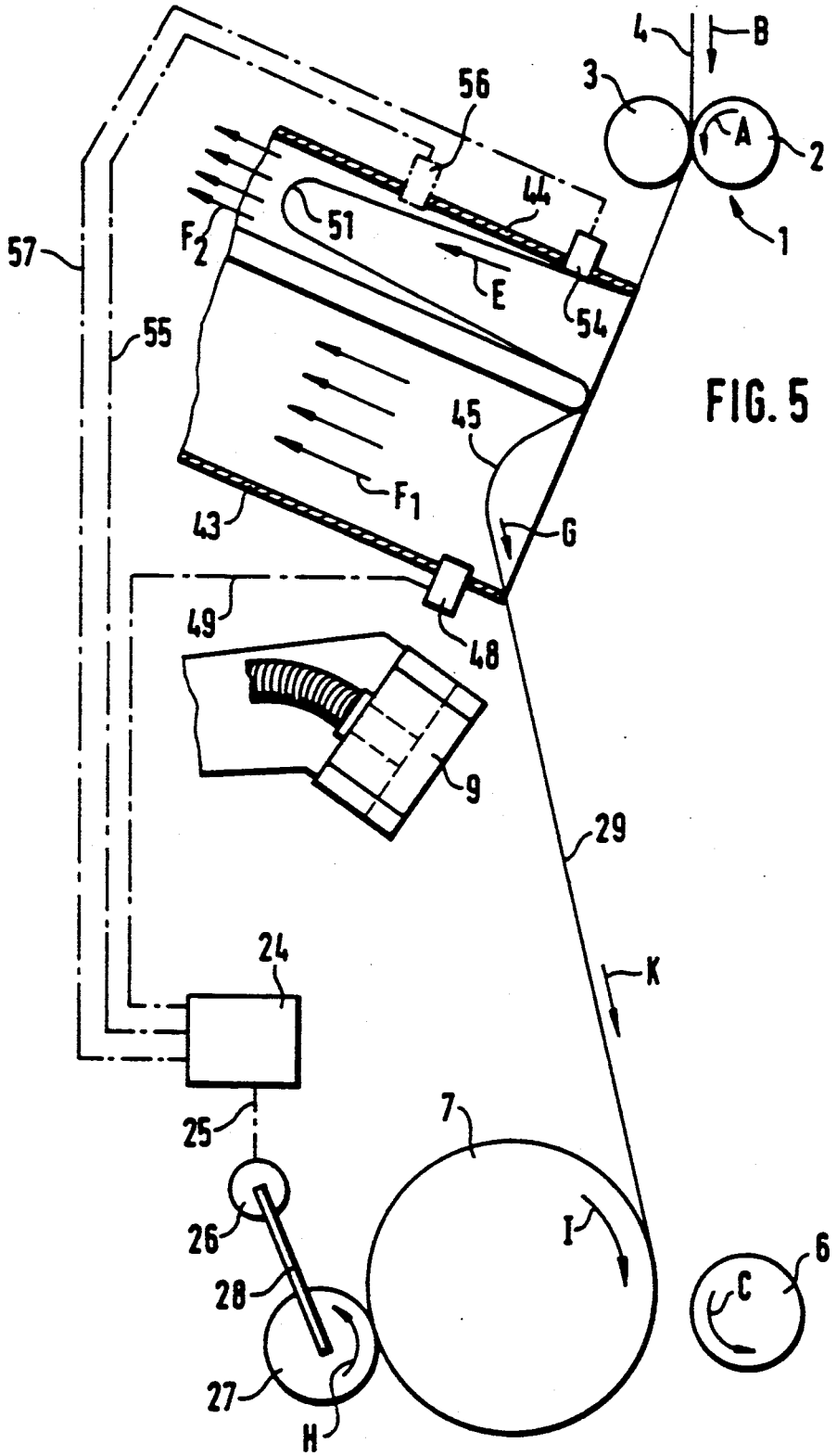
FIG. 5 is a view similar to FIG. 1 of another embodiment of the invention having an additional storage device receiving a yarn loop of a defined length, during the evacuation of the intermediate storage device.

In the embodiment according to FIG. 5, an additional storage device 44 is connected in front of an intermediate storage device 43. The intermediate storage device 43 is connected to a suction air source Fl. The intermediate storage device 43 also has a tube-shaped construction which is open in the direction of the moving path of the yarn. Correspondingly, the additional storage device 44 also has a tube-shaped construction which is open in the direction of the moving path of the yarn and which can be connected to a suction air source F2. During the establishment of the yarn connection in the splicing arrangement 9, only the intermediate storage device 43 is activated. After the establishing of the yarn connection, the connected yarn 29 is withdrawn in wind-up direction by means of the driving of the auxiliary winding roller 27.

The intermediate storage device 43 is equipped with a detector 48 assigned to the yarn loop 45 which is connected to the control device 24 by means of a line 49. As soon as the yarn loop 45 has reached a residual size and leaves the area of the detector 48, the control device 24 connects the additional storage device 44 to the suction source F2. The yarn which is subsequently delivered by the delivery 1 then, in the direction of arrow (E), moves into the additional storage device 44 and is held there in the shape of a loop 51. It is only when the intermediate storage device 43 is evacuated by the withdrawal in the direction of the arrow (G), that the evacuation of the additional storage device 44 starts. The additional storage device 4 is equipped with at least one detector 54 which is connected by way of a line 57, to the control device 24. When the loop 51 has left the range of this detector 54, the computer of the control device 24 computes the remaining time before the full intermediately stored length is used up and controls the device 26 of the auxiliary winding roller 27 respectively, i.e., with a smooth reduction from the high wind-up speed to the operative winding speed.

In the embodiment according to FIG. 5, in addition, a second detector 56 is arranged at an axial distance of the additional storage device 44 with respect to the detector 54. This detector 56, is also connected to the control device 24 by means of a connecting line 55. As a result, it is made possible to monitor the evacuation of the additional storage device 54 at two points in time, i.e., also the source of the reduction of the wind-up speed of the package spool. As a result of the signal of the first-responding detector 56, the computer of the control device 24 determines the remaining residual time before the intermediately stored yarn length is completely used up. As a result of the signal of detector 54 which is also fed to the computer, this computer can determine whether the intended speed reduction is taking place as desired or not. In an emergency, a correction can still be carried out here.

As a modification of the embodiment according to FIG. 5, it may be provided that the additional storage device 44 is a component of the spinning machine, i.e., is arranged at each spinning point. In this case, the servicing arrangement may already transfer the package spool 7 to the winding roller 6 after the evacuation of the intermediate storage device 43, after which the servicing arrangement can then move on. The evacuation of the additional storage device 44 will than take place over a longer time period at the respective spinning point itself.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A splicing arrangement for carrying out a yarn splicing operation at a spinning point of a spinning machine of the type having a yarn delivery device for delivering yarn spun at the spinning point and a yarn package winding device for winding yarn from the spinning point onto a package, said splicing arrangement comprising:

a splicing device for splicing new yarn delivered by the delivery device with old yarn withdrawn from the yarn package, an intermediate yarn storage device disposed upstream of the splicing device for storing new yarn delivered by the delivery device during splicing in the splicing device, and winding control apparatus for controlling the winding device so as to increase the speed of the winding of the yarn package as compared to its normal spinning operation speed during normal spinning operations to thereby withdraw yarn from the intermediate yarn storage device after splicing operations in the splicing device are completed, said winding device control apparatus including a stored yarn detection device for detecting the amount of intermediate stored yarn remaining in the storage device and means for effecting a reduction in the speed of the winding of the yarn package toward its normal spinning operation speed when the amount of yarn remaining in the storage device reaches a predetermined low level to thereby minimize tension peaks in the yarn being withdrawn from the storage device.

2. An arrangement according to claim 1, wherein the yarn detection device includes a detector for detecting the length of a yarn loop in the intermediate storage device.

3. An arrangement according to claim 2, wherein the intermediate storage device comprises a tube which is open on one side which can be applied to the path of the yarn and wherein a suction air source is connected to the tube to generate a suction pull which pulls the yarn into the tube in the form of a loop, and wherein the detector includes means for creating a light barrier in the tube.

4. An arrangement according to claim 1, wherein the yarn detection device includes a detector for detecting a point in time when a stored yarn loop in the intermediate storage device has a predetermined residual size during withdrawal of yarn from the intermediate storage device.

5. An arrangement according to claim 1, wherein an additional storage device is provided upstream of the intermediate storage device for receiving a predetermined yarn length during delivery of new yarn by the delivery device during splicing operations, and wherein the yarn detection device includes a detector for detecting the yarn at a point in time when it empties from the intermediate storage device.

6. An arrangement according to claim 1, wherein the yarn detection device includes a detector for detecting the extent of winding of yarn on the yarn package subsequent to completion of splicing operations.

7. An arrangement according to claim 1, wherein the yarn detection device includes a detector for detecting the yarn length withdrawn from the intermediate storage device after completion of splicing operations.

8. An arrangement according to claim 1, wherein the intermediate storage device comprises a tube which is open on one side which can be applied to the path of the yarn and wherein a suction air source is connected to the tube to generate a suction pull which pulls the yarn into the tube in the form of a loop.

9. An arrangement according to claim 1 wherein the yarn detection device includes a detector for detecting rotation of the yarn package after completion of the splicing operation.

10. An arrangement according to claim 1, wherein the winding control apparatus includes a computer control device for controlling the speed of the winding of the yarn package as a function of signals from the yarn detection device.

11. An arrangement according to claim 10, wherein the winding of the yarn package is controlled by a driven winding device during normal spinning operations.

12. An arrangement according to claim 11, wherein an auxiliary package driving device is provided for splicing operations, and wherein the speed of the winding of the yarn package is controlled by controlling the auxiliary package driving device.

13. An arrangement according to claim 12, wherein the auxiliary package driving device is provided on a mobile splicing unit which is selectively movable to respective spinning points of a multiple spinning point spinning machine.

14. An arrangement according to claim 13, wherein the intermediate storage device is carried by the mobile splicing unit.

15. An arrangement according to claim 14, wherein the yarn detection device includes a detector for detecting the length of a yarn loop in the intermediate storage device.

16. An arrangement according to claim 14, wherein the yarn detection device includes a detector for detecting a point in time when a stored yarn loop in the intermediate storage device has a predetermined residual size during withdrawal of yarn from the intermediate storage device.

17. An arrangement according to claim 10, wherein the computer control device and intermediate storage device are carried on a mobile splicing unit which is selectively movable to respective spinning points of a multiple spinning point spinning machine.

18. An arrangement according to claim 17, wherein the yarn detection device includes a detector for detecting the length of a yarn loop in the intermediate storage device.

19. An arrangement according to claim 17, wherein the yarn detection device includes a detector for detecting a point in time when a stored yarn loop in the intermediate storage device has a predetermined residual size during withdrawal of yarn from the intermediate storage device.

20. An arrangement according to claim 17, wherein an additional storage device is provided upstream of the intermediate storage device for receiving a predetermined yarn length during delivery of new yarn by the delivery device during splicing operations, and wherein the yarn detection device includes a detector for detecting the yarn at a point in time when it empties from the intermediate storage device.

21. An arrangement according to claim 17, wherein the yarn detection device includes a detector for detecting the extent of winding of yarn on the yarn package subsequent to completion of splicing operations.

22. An arrangement according to claim 17, wherein the yarn detection device includes a detector for detecting the yarn length withdrawn from the intermediate storage device after completion of splicing operations.

23. An arrangement according to claim 17, wherein the intermediate storage device comprises a tube which is open on one side which can be applied to the path of the yarn and wherein a suction air source is connected to the tube to generate a suction pull which pulls the yarn into the tube in the form of a loop.

24. An arrangement according to claim 1, wherein said spinning point includes spinning means for spinning a yarn having only a relatively low resistance to tearing and formed by prestrengthening with pneumatic false twist spinning.

25. An arrangement according to claim 10, wherein said spinning point includes spinning means for spinning a yarn having only a relatively low resistance to tearing and formed by prestrengthening with pneumatic false twist spinning.

* * * * *